US006681752B1

(12) United States Patent
Kreikemeier et al.

(10) Patent No.: US 6,681,752 B1
(45) Date of Patent: Jan. 27, 2004

(54) FUEL INJECTION SYSTEM METHOD AND APPARATUS USING OXYGEN SENSOR SIGNAL CONDITIONING TO MODIFY AIR/FUEL RATIO

(75) Inventors: Michael L Kreikemeier, Belgrade, MT (US); Chad D Beauregard, Belgrade, MT (US)

(73) Assignee: Dynojet Research Company, North Las Vegas, NV (US)

( * ) Notice: Subject to any disclaimer, the term of this patent is extended or adjusted under 35 U.S.C. 154(b) by 0 days.

(21) Appl. No.: 10/212,475

(22) Filed: Aug. 5, 2002

(51) Int. Cl.[7] ..... F02D 41/00
(52) U.S. Cl. ..... 123/683; 123/687
(58) Field of Search ..... 123/683, 687, 123/674, 672

(56) References Cited

U.S. PATENT DOCUMENTS

| | | | |
|---|---|---|---|
| 4,143,623 | A | 3/1979 | Norimatsu et al. |
| 4,163,433 | A | 8/1979 | Fujushiro |
| 4,202,301 | A | 5/1980 | Early et al. |
| 4,263,652 | A | 4/1981 | Henrich |
| 4,502,444 | A | 3/1985 | Rubbo et al. |
| 4,526,001 | A | 7/1985 | Burns et al. |
| 4,566,419 | A | 1/1986 | Ninomiya et al. |
| 4,980,834 | A | 12/1990 | Ikeda et al. |
| 5,762,055 | A | 6/1998 | Yamashita et al. |
| 6,189,523 | B1 | 2/2001 | Weisbrod et al. |

*Primary Examiner*—Bibhu Mohanty
(74) *Attorney, Agent, or Firm*—Allan Jacobson

(57) ABSTRACT

A method and apparatus for externally modifying the operation of a closed loop electronic fuel injection control system that is normally used with a standard oxygen sensor, which method and apparatus includes replacing the standard oxygen sensor with a wide band oxygen sensor. The signal from the wide band oxygen sensor is processed in a first signal-conditioning module and coupled to the input of the electronic fuel injection control system. The first signal-conditioning module simulates the appearance of a standard oxygen sensor to the electronic fuel injection control system. In a second embodiment, a method and apparatus for externally modifying the operation of a closed loop electronic fuel injection control system that is normally used with a wide band oxygen sensor, includes intercepting the signal from the wide band oxygen sensor in a second signal-conditioning module. The second signal-conditioning module receives a first current from the wide band oxygen sensor and provides a second current to the electronic fuel injection control system.

19 Claims, 6 Drawing Sheets

FUEL INJECTION SYSTEM METHOD AND APPARATUS USING OXYGEN SENSOR SIGNAL CONDITIONING TO MODIFY AIR/FUEL RATIO

FIELD OF THE INVENTION

The present invention relates to control systems for controlling the air to fuel ratio in an internal combustion engine.

BACKGROUND OF THE INVENTION

Internal combustion engines mix air and fuel in a prescribed ratio to facilitate combustion. Engine performance and economy is affected by the air/fuel ratio. In particular, a stoichiometric air/fuel mixture achieves optimum fuel economy. For gasoline, a stoichiometric air/fuel mixture is 14.7 parts air to 1 part fuel by weight. Air/fuel ratios richer than stoichiometric (e.g. less than 14.7:1) result in increased engine power output at the expense of fuel economy. Air to fuel ratios leaner than stoichiometric (e.g. greater than 14.7:1) can lead to engine performance problems.

Some internal combustion engines mix fuel and air in a carburetor using a spray nozzle to inject fuel droplets into an air stream passing into the engine cylinders. However, modern internal combustion engines use an electronic fuel injection system to replace the carburetor as a more accurate and reliable fuel delivery system. In an electronic fuel injection system, fuel and air are mixed in the engine intake manifold by spraying fuel droplets through a fuel injector directly into the air flow. An engine control unit (ECU) maintains the desired air to fuel ratio by controlling the amount of fuel injected by the fuel injectors. The ECU is operated either closed loop mode or open loop mode.

Some prior art electronic fuel injection systems operated only in open loop mode. In open loop mode, air and fuel are delivered to the engine in accordance with a table of target air/fuel ratios internally stored in the ECU. The stored table, also known as a fuel map, is based on engine operating conditions such as throttle position, engine RPM (speed in revolutions per minute), engine temperature, air temperature and ambient air pressure. The fuel map determines the fuel delivery profile for the engine. It is known in the art that modifying the fuel map can enhance engine performance and/or fuel economy.

However, modifying the internally stored fuel map may require replacement of memory components in ECU, unless the ECU memory is electrically re-programmable, which is not typical. It is known in the art to enhance engine performance by modifying the fuel flow signals provided by the ECU to the fuel injectors. That is, the internal fuel map of the ECU is effectively modified by externally intercepting and modifying the fuel flow control signals from the ECU to the fuel supply system. The net resulting engine fuel map is, in effect, a new fuel delivery profile for the engine.

Some electronic fuel injection control systems operate in a closed loop mode in which the air/fuel ratio is directly sensed and used in an adaptive feedback control system. To sense the air/fuel ratio, a typical fuel injection system includes a standard oxygen ($O_2$) sensor placed in the exhaust flow of the engine. Unused (unburned) oxygen in the exhaust gasses indicates a leaner air/fuel mixture (i.e., too much oxygen for the amount of fuel). Lack of oxygen in the exhaust gases indicates a richer air/fuel mixture (i.e., not enough oxygen for the amount of fuel).

For air/fuel mixtures leaner than 14.7, the standard oxygen sensor outputs a value of about 0.2 volts indicating the presence of excess oxygen in the exhaust gasses. For air/fuel mixtures richer than 14.7 the standard oxygen sensor outputs a value of about 0.8 volts indicating oxygen depletion in the exhaust gasses. In the region around stoichiometric, the transition between 0.2 and 0.8 volts is relatively abrupt. The standard oxygen sensor is also referred to as a rich/lean sensor.

The signal output of the standard oxygen sensor is an input signal to the ECU. In closed loop mode, the signal from the standard oxygen sensor is used by the ECU to control the amount of fuel sent to the fuel injectors so as to maintain an air to fuel ratio of 14.7. Specifically, a threshold of 0.5 volts is established. When the oxygen sensor output falls below 0.5, the fuel flow to the fuel injectors is increased. When the oxygen sensor output rises above 0.5, the fuel flow to the fuel injectors is decreased. The air/fuel ratio moves above and below the stoichiometric value of 14.7 as the signal from the standard oxygen sensor to the ECU fluctuates between 0.2 and 0.8 volts.

Closed loop systems typically operate in open loop mode part of the time, where the signal from the standard oxygen sensor is not used. Open loop mode is needed when the operator demands more horsepower from the engine, such as would be needed for acceleration when passing another vehicle. In open loop mode, the ECU outputs fuel flow control signals in accordance with an internally stored fuel map, while ignoring the feedback signal from the standard oxygen sensor.

The prior art technique of adding an external product to modify the fuel flow signal from the ECU is not effective in closed loop mode. When the external add-on product attempts to adjust the fuel flow to a value other than prescribed by the ECU, the ECU (which is still involved in fuel flow management and operating in closed loop mode) quickly readjusts its output in an attempt to fluctuate about a stoichiometric mixture. In other words, the add-on product and the ECU in closed loop mode conflict with each other.

And as indicated above, the oxygen sensor output transition around stoichiometric is abrupt. Furthermore, the characteristics of a standard oxygen sensor outside of its narrow stoichiometric range of operation are unstable. Although it is possible to intercept and condition the signal from a standard oxygen sensor, it is not a reliable way to adjust the air/fuel ratio to a value other than that prescribed by the ECU responsive to the standard oxygen sensor. The abrupt transition and unstable characteristics make it difficult to use the output of the standard oxygen sensor to achieve air/fuel ratios other than the stoichiometric value of 14.7:1.

SUMMARY OF THE INVENTION

The present invention is embodied in a method and apparatus for externally modifying the operation of a closed loop electronic fuel injection control system to effectively modify the engine fuel delivery profile (effective engine fuel map) to enhance engine performance.

In accordance with a first embodiment the present invention, the operation of a closed loop electronic fuel injection control system normally used with a standard oxygen sensor, is modified using an external apparatus to effectively modify the engine fuel delivery profile. The standard oxygen sensor is replaced with a wide band oxygen sensor that is capable of sensing exhaust gas properties as a measure of the actual air/fuel ratio of the intake combustion mixture over a broad range of air/fuel ratio values. The signal from the wide band oxygen sensor is intercepted, processed in a first signal-conditioning module and coupled to the input of a first type of ECU normally used with a standard oxygen sensor. The first type of ECU is programmed to seek a stoichiometric target air/fuel ratio for each closed loop engine operating condition.

For each engine operating condition (throttle position, RPM, etc.) the first signal-conditioning module determines a new target air/fuel ratio. When the signal from the wide band oxygen sensor indicates the new target air/fuel ratio, the first signal conditioning module outputs a signal simulating the output of a standard oxygen sensor at stoichiometric air/fuel ratio to said first type of ECU normally used with a standard oxygen sensor. That is, at the new target air/fuel ratio, the first signal-conditioning module outputs a signal that moves between 0.2 and 0.8 volts, thereby simulating the output of a standard oxygen sensor, so that it appears to the first type of ECU as a standard oxygen sensor operating at a stoichiometric air/fuel ratio.

In such manner, a new engine fuel delivery profile is provided by the first signal-conditioning module in a fuel injection control system having said first type of ECU normally used with a standard oxygen sensor.

In accordance with a second embodiment of the present invention, the operation of a closed loop electronic fuel injection control system that normally utilizes a wide band oxygen sensor in conjunction with a second type of ECU, is modified using a second signal-conditioning module to effectively modify the engine fuel delivery profile (effective engine fuel map) to enhance engine performance. The signal from the wide band oxygen sensor is intercepted and processed in said second signal-conditioning module. The output of the second signal-conditioning module is coupled to the input of said second type of ECU normally used to receive signals from a wide band oxygen sensor.

For each engine operating condition (throttle position, RPM, etc.), the second type of ECU has a programmed target air/fuel ratio in its internally stored fuel map. For each of those same engine operating conditions (throttle position, RPM, etc.), the second signal-conditioning module stores a corresponding new target air/fuel ratio. The second signal conditioning module determines when the signal from the wide band oxygen sensor represents the new target air/fuel ratio, and substitutes a signal representing the originally programmed target air/fuel ratio value as an input signal to the second type of ECU. That is, at the new target air/fuel ratio, the second signal-conditioning module outputs a current signal that simulates the output of a wide band oxygen sensor operating at the originally programmed target air/fuel ratio. Thus, the second signal-conditioning module appears to the second type of ECU as a wide band oxygen sensor operating at the originally programmed target air/fuel ratio.

In such manner, a new engine fuel delivery profile is provided by the second signal conditioning module in a fuel injection control system having said second type of ECU normally used with a wide band oxygen sensor.

DETAILED DESCRIPTION

Figure 1:
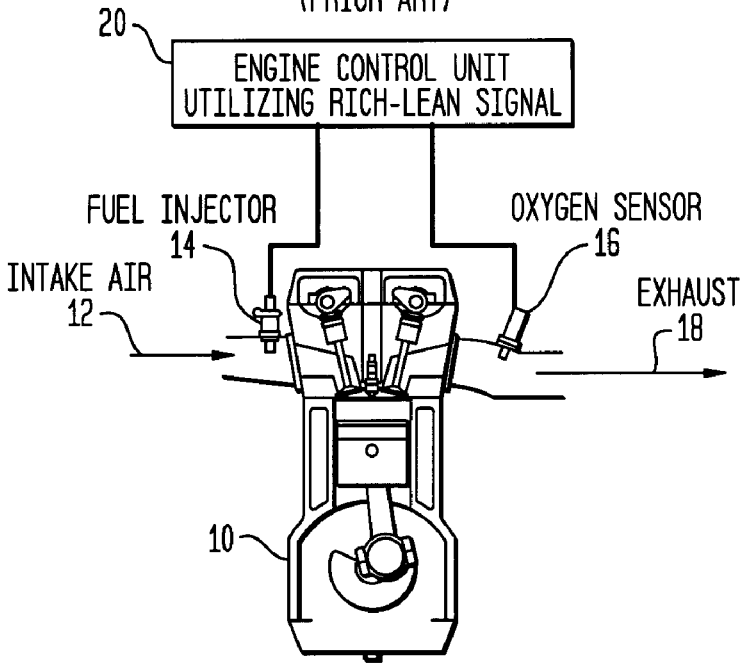
FIG. 1 (PRIOR ART)
FIG. 1 is a block diagram of a closed loop fuel injection control system using a standard oxygen sensor in accordance with the prior art.

A typical closed loop fuel injection system using a standard oxygen sensor is shown in FIG. 1. The overall system includes an internal combustion engine 10 having an intake air channel 12 and an exhaust channel 18, a standard oxygen sensor 16, a fuel injector 14 and an electronic control unit 20. Under control of the ECU 20, the fuel injector 14 sprays fuel droplets to mix with the intake air 12. The standard oxygen sensor 16 is placed in the exhaust channel 18 in the path of the engine exhaust gasses.

In normal operation, the standard oxygen sensor 16 provides ECU 20 with an indication of the presence of oxygen in the exhaust gasses, which provides information about the intake gas mixture entering the engine. If oxygen is present the output of sensor 16, the output is 0.2 volts. As the concentration of oxygen approaches zero, the output voltage jumps to 0.8 volts. Thus, a typical standard oxygen sensor outputs 0.8 volts when the intake air/fuel ratio is rich (less than 14.7) and outputs 0.2 volts when the intake air/fuel ratio is lean (greater than 14.7). The characteristics of the standard oxygen sensor (having a rich/lean signal output) is not stable is enough to be used to control the air/fuel ratio at a steady 14.7:1. Instead, the standard oxygen sensor is used primarily as an indicator of whether the intake mixture is too rich or too lean, relative to stoichiometric.

Figure 1A:
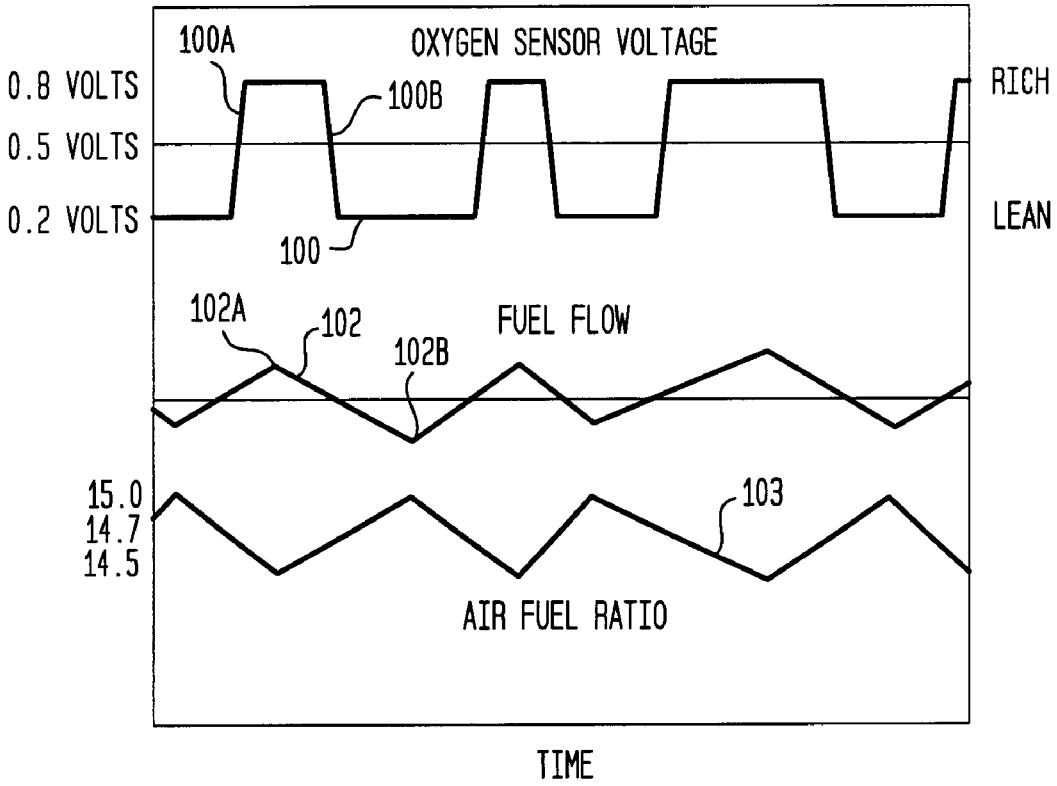
FIG. 1A is a timing diagram illustrating the operation of the fuel injection control system of FIG. 1 using a standard oxygen sensor in accordance with the prior art.

As illustrated in the timing diagram of FIG. 1A, ECU 20 increases fuel flow through the fuel injectors 14 until the standard oxygen sensor voltage output 100 rises above the 0.5 volts axis 100A. After the standard oxygen sensor output voltage 100 is above the 0.5 volt axis for a prescribed length of time, the ECU 20 begins to decrease 102A the fuel flow through the fuel injectors. The fuel flow continues to decrease until the standard oxygen sensor output voltage 100 drops below the 0.5 volts axis 100B. After the standard oxygen sensor voltage output 100 is below the 0.5 volt axis for a prescribed length of time, the ECU 20 begins to increase 102B the fuel flow through the fuel injectors. The result is that the standard oxygen sensor output voltage 100 moves back and forth between 0.8 volts and 0.2 volts representing a too rich or too lean intake mixture, respectively.

The air/fuel mixture does not stabilize at 14.7:1 precisely. Instead the air/fuel continually switches between rich and lean on each side of 14.7:1. The sawtooth shape of the resultant air/fuel ratio graph 103 is a result of the ECU 20 "hunting" to establish a stoichiometric intake air/fuel ratio.

Wide Band Oxygen Sensor

Figure 2:
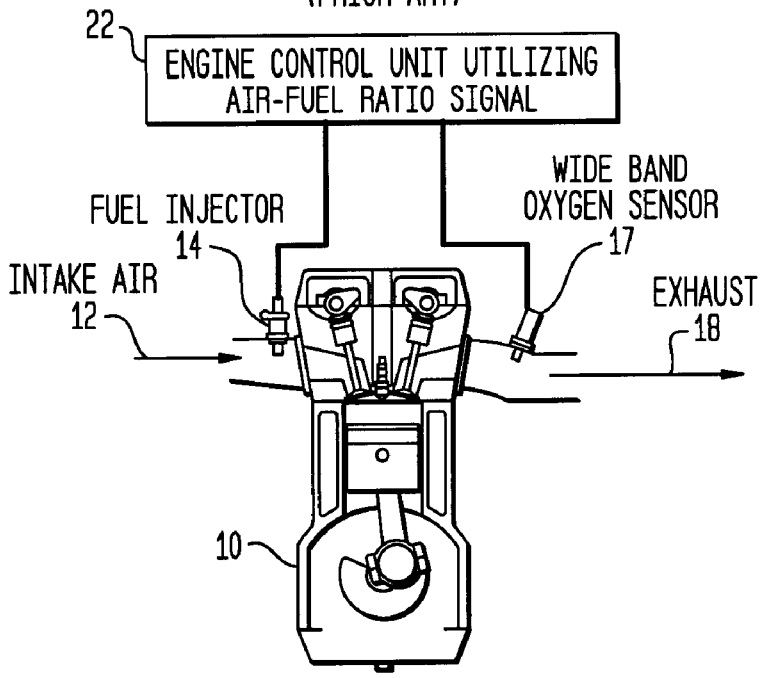
FIG. 2 (PRIOR ART)
FIG. 2 is a block diagram of a closed loop fuel injection control system using a wide band oxygen sensor in accordance with the prior art.

A typical closed loop fuel injection system using a wide band oxygen sensor is shown in FIG. 2. The overall system includes an internal combustion engine 10 having an intake air channel 12 and an exhaust channel 18, a wide band oxygen sensor 17, a fuel injector 14 and an electronic control unit 22. Under control of the ECU 22, the fuel injector 14 sprays fuel droplets to mix with the intake air 12. The wide band oxygen sensor 17 is placed in the exhaust channel 18, in the path of the engine exhaust gasses.

A wide band oxygen sensor 17 senses the presence of fuel as well as oxygen in the exhaust gasses. That is, the wide band oxygen sensor 17 is capable of measuring the quantity of unburned fuel or unused oxygen present in the exhaust gasses 18. If oxygen is present in the exhaust gasses 18, the sensor 17 output current is positive and proportional to the concentration of oxygen. If unburned fuel is present in the exhaust gasses 18 the sensor 17 output current is negative and proportional to the unburned fuel concentration. If there is no oxygen or unburned fuel in the exhaust 18, the sensor 17 output current is zero, which implies that the engine intake air/fuel ratio is at the stoichiometric (14.7: 1) ratio.

A wide band oxygen sensor permits a fuel injection control system to provide a range of closed loop operations (other than stoichiometric) that include best power settings for various conditions, such as passing or cruising, as well as for optimum fuel economy or optimum emission control settings. The wide band oxygen sensor 17 allows the ECU 22 to control fuel flow to a specific programmed target air/fuel ratio rather than to fluctuate above and below a stoichiometric air/fuel ratio determined by the inherent characteristic of a standard oxygen sensor of (16 in FIG. 1).

A closed loop fuel injection system using a wide band oxygen sensor as in FIG. 2 operates differently as compared to a closed loop fuel injection system using a standard oxygen sensor as in FIG. 1. In the case of a standard oxygen sensor in FIG. 1, a stoichiometric air/fuel ratio is achieved by increasing (or decreasing) fuel flow to the fuel injectors until the standard oxygen sensor switches output. Thus, with a standard oxygen sensor in FIG. 1 there is a "hunting" about a stoichiometric air/fuel ratio. In the case of a wide band oxygen sensor in FIG. 2, target air/fuel ratios from the internally stored fuel map are achieved by increasing (or decreasing) fuel flow to the fuel injectors until the programmed target air/fuel ratio is sensed by the wide band oxygen sensor 17. A closed loop fuel injection control system (as in FIG. 2) operates in accordance with feedback control system principles to achieve rapid and stable convergence without hunting about the programmed target air/fuel ratio.

Figure 2A:
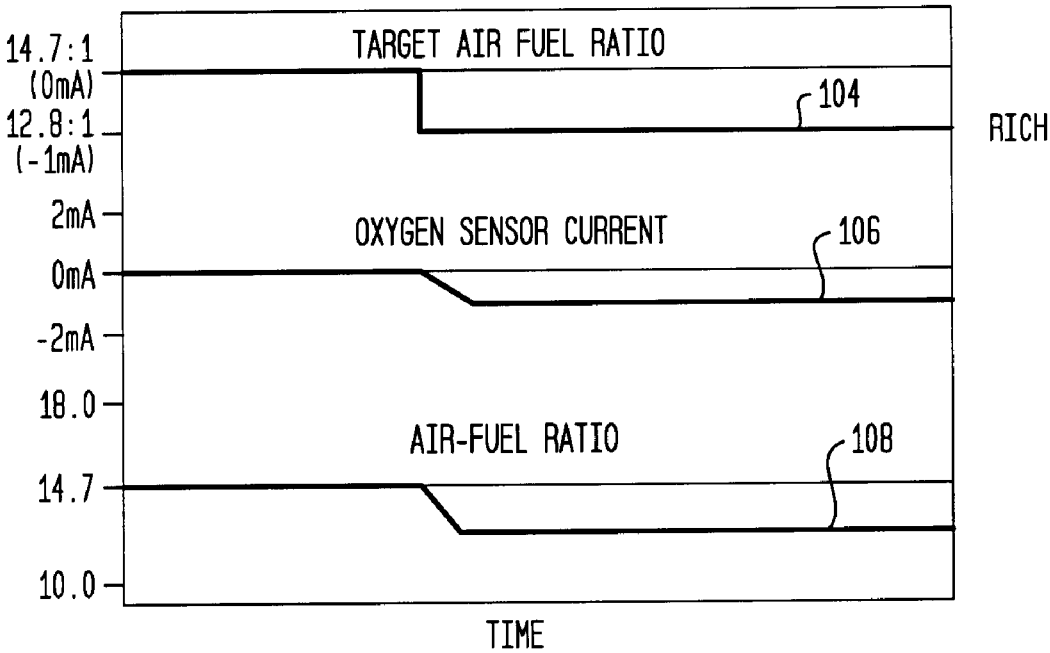
FIG. 2A (PRIOR ART)
FIG. 2A is a timing diagram illustrating the operation of the fuel injection control system of FIG. 2 using a wide band oxygen sensor in accordance with the prior art.

FIG. 2A illustrates the operation of a closed loop fuel injection system using a wide band oxygen sensor. As shown in FIG. 2A, the ECU 22 responsive to its internal fuel map attempts to adjust the air/fuel ration to a desired target air/fuel ratio 104. In particular, the target air/fuel ratio 104 goes from a stoichiometric mixture of 14.7:1 to a richer mixture of 12.8:1. The ECU 22 gradually increases fuel flow. As a result, the current output 106 of the wide band oxygen sensor goes from 0 to −1 milliamperes. The transition between wide band oxygen sensor current output levels 106 is gradual rather than abrupt, as is the transition of the air/fuel ratio 108 as it goes from stoichiometric 14.7:1 to a richer 12.8:1.

Figure 3:
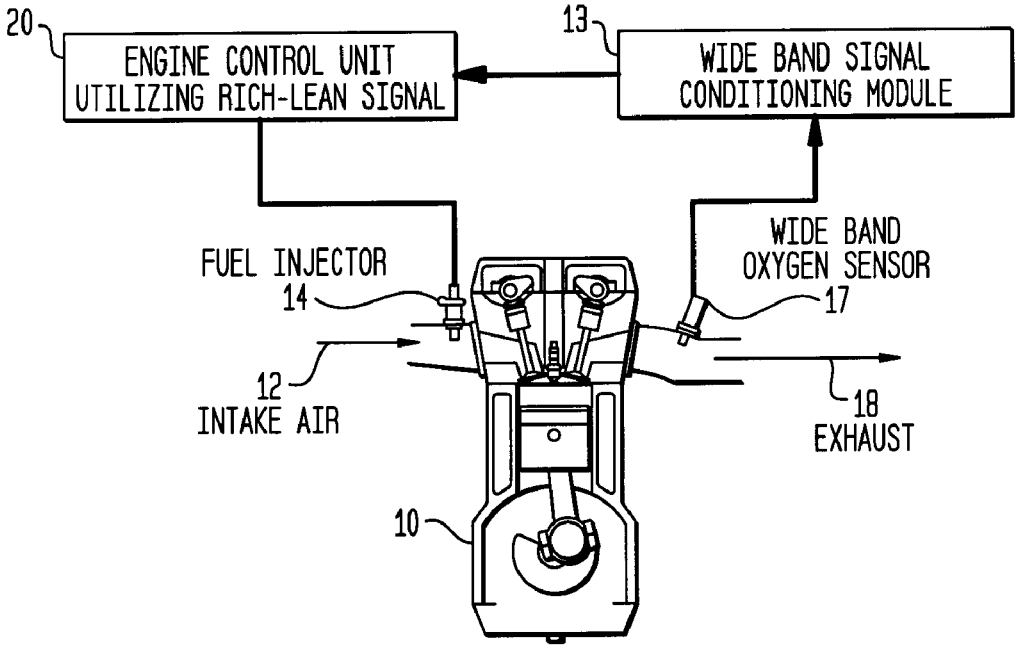
FIG. 3 is a block diagram of a closed loop fuel injection control system in accordance with the present invention.

FIG. 3 illustrates the use of a wide band signal-conditioning module 13 for externally modifying the operation of a closed loop electronic fuel injection control system having an ECU 20 that normally receives the rich/lean signal from a standard oxygen sensor. The overall system includes an internal combustion engine 10 having an intake air channel 12 and an exhaust channel 18, a fuel injector 14 and an electronic control unit 20.

The unmodified system of FIG. 1 uses a standard oxygen sensor 16. In accordance with the present invention, a wide band oxygen sensor 17 in FIG. 2 replaces the standard oxygen sensor 16 of FIG. 1 in the exhaust channel 18. In addition, the signal from the wide band oxygen sensor 17 is processed in a wide band signal conditioning module 13. The output of the wide and signal conditioning module 13 is coupled to ECU 20.

Figure 3A:
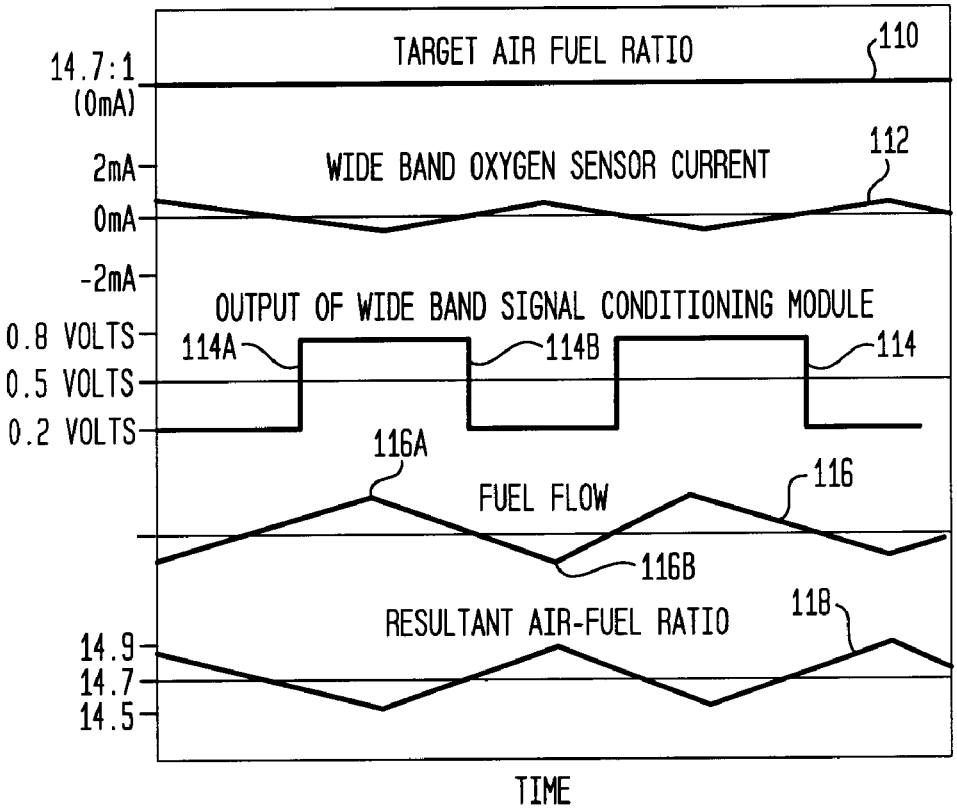
FIGS. 3A and 3B are timing diagrams illustrating the operation of the fuel injection control system of FIG. 3 in accordance with the present invention.

FIG. 3A illustrates the operation of the system of FIG. 3 to achieve the (stoichiometric) target air/fuel ratio 110. The output of the wide band signal conditioning module 114 is either at 0.2 volts or at 0.8 volts. In such manner, the wide band signal conditioning module 13 simulates the output of a standard oxygen sensor to the ECU 20.

As illustrated in the timing diagram of FIG. 3A, ECU 20 increases fuel flow through the fuel injectors 14 until the wide band oxygen sensor voltage output 114 rises above the 0.5 volts axis 114A. After the wide band oxygen sensor output voltage 114 is above the 0.5 volt axis for a prescribed length of time, the ECU 20 begins to decrease the fuel flow 116A through the fuel injectors. The fuel flow continues to decrease until the wide band oxygen sensor output voltage 114 drops below the 0.5 volts axis 114B. After the wide band oxygen sensor voltage output 114 is below the 0.5 volt axis for a prescribed length of time, the ECU 20 begins to increase the fuel flow 116B through the fuel injectors.

The result is that the fuel flow to the fuel injectors is increased and decreased about an average value of fuel flow representing the amount of fuel necessary to achieve a stoichiometric air/fuel ratio. The air/fuel mixture does not stabilize at 14.7:1 precisely. Instead, the air/fuel ratio continually switches between rich and lean on either side of 14.7:1. The sawtooth shape of the air/fuel ratio graph 118 is a result of the ECU 20 "hunting" to establish a stoichiometric intake air/fuel ratio. At the stoichiometric target value 110, the output 112 of the wide band oxygen sensor varies slightly above and below (i.e., hunts about) the axis representing zero output current.

The wide band signal conditioning module appears to the ECU 20 to be a standard oxygen sensor. The wide band signal conditioning module output voltage 114 moves back and forth between 0.8 volts and 0.2 volts signaling a too rich or too lean intake mixture to the ECU 20. At the same time, the output 112 of the wide band oxygen sensor varies slightly above and below the axis representing a stoichiometric air/fuel ratio (zero output current).

Figure 3B:
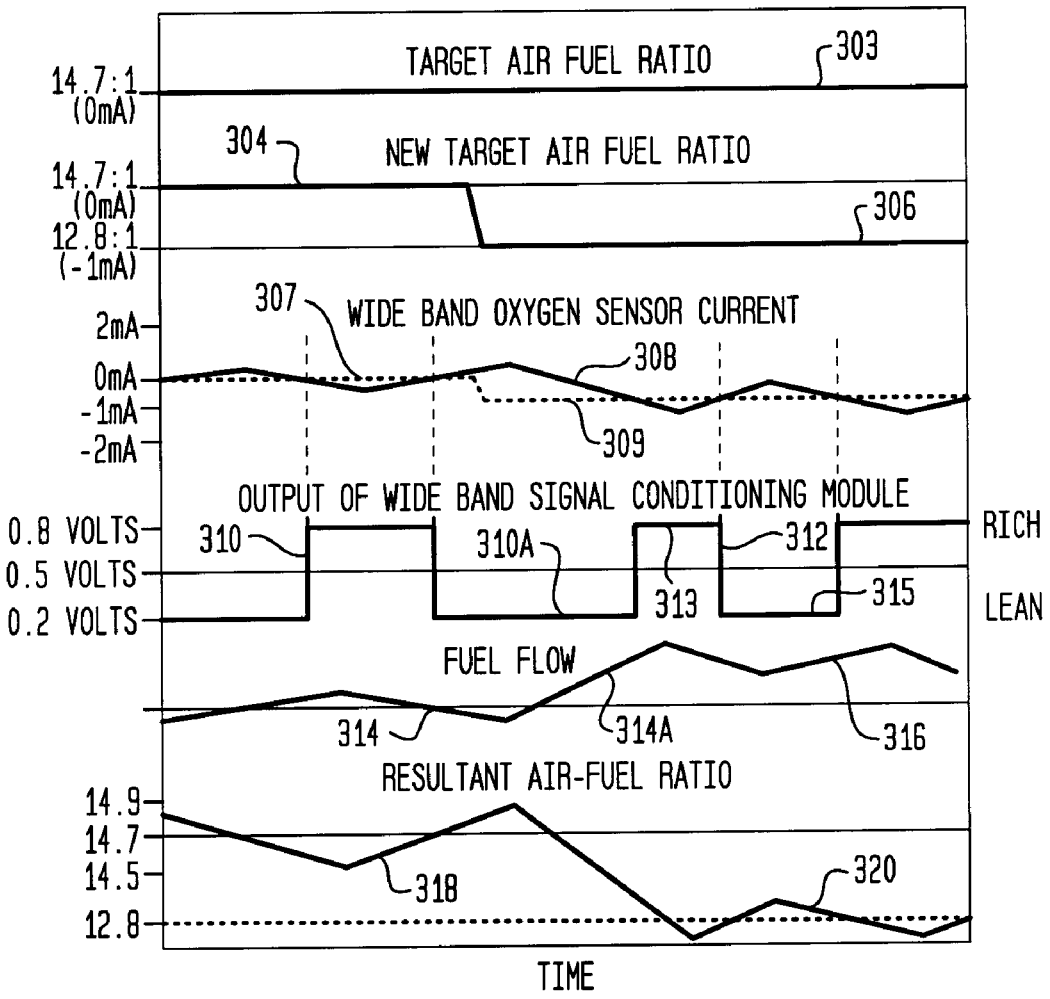

FIG. 3B shows what happens when the target air/fuel ratio 303 is changed to a new target air/fuel ratio. In particular, the stoichiometric value 304 of the new target air/fuel ratio changes to a different value 306 for the new target air/fuel ratio. In response, the wide band signal conditioning module 13 (FIG. 3) signals the ECU 20 that the air/fuel mixture is lean 310A. In response, ECU 20 increases 314A the fuel flow to the fuel injectors. ECU 20 continues to increase the fuel flow to the fuel injectors until the output of the wide band signal conditioning module 13 indicates that the air/fuel mixture is rich 313.

In response, ECU 20 decreases the fuel flow to the fuel injectors until the output of the wide band signal conditioning module 13 indicates that the air/fuel mixture is lean 315. The new fuel flow level 316 is generally higher than the prior fuel flow level 314. As a result, the new air/fuel ratio 320 is generally lower than the prior air/fuel ratio 318. In such manner, the air/fuel ratio is set at a richer (12.8) level.

At the stoichiometric value 304, the output of the wide band oxygen sensor varies slightly above and below (i.e., hunts about) the axis 307 representing zero output current. In comparison, at the new target air/fuel ratio 306, the output 308 of the wide band oxygen sensor varies slightly above and below (i.e., hunts about) the axis 309 representing minus 1 milliampere output current (corresponding to an air/fuel ratio of 12.8).

Although the new target air/fuel ratio of 12.8 has been achieved, the ECU 20 receives output signals from the wide band signal conditioning module 13 representing an air/fuel ratio of 14.7 (stoichiometric) of a standard oxygen sensor. The wide band signal conditioning module 13 tricks the ECU 20 into achieving a richer air/fuel ratio by appearing to be a standard oxygen sensor operating at a stoichiometric air/fuel ratio value.

Figure 4:
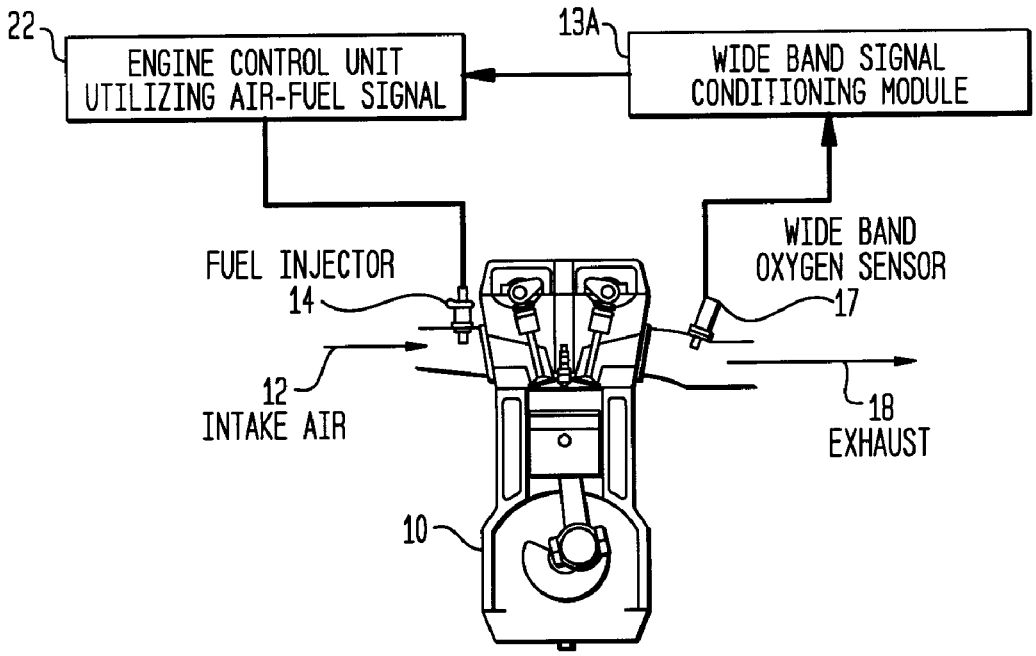
FIG. 4 is a block diagram of a closed loop fuel injection control system in accordance with a second embodiment of the present invention.

FIG. 4 illustrates the use of a wide band signal-conditioning module 13A for externally modifying the operation of a closed loop electronic fuel injection control system having an ECU 22 that normally receives the output current of a wide band oxygen sensor. The overall system includes an internal combustion engine 10 having an intake air channel 12 and an exhaust channel 18, a fuel injector 14 and an electronic control unit 22.

An unmodified system (FIG. 2) uses a wide band oxygen sensor 17 coupled to an ECU 22 of the type that is normally connected to a wide band oxygen sensor 17. In accordance with the present invention, the signal from the wide band oxygen sensor 17 is disconnected from ECU 22 and processed in a wide band signal conditioning module 13A (FIG. 4). The output of the wide and signal conditioning module 13A is coupled to ECU 22.

Figure 4A:
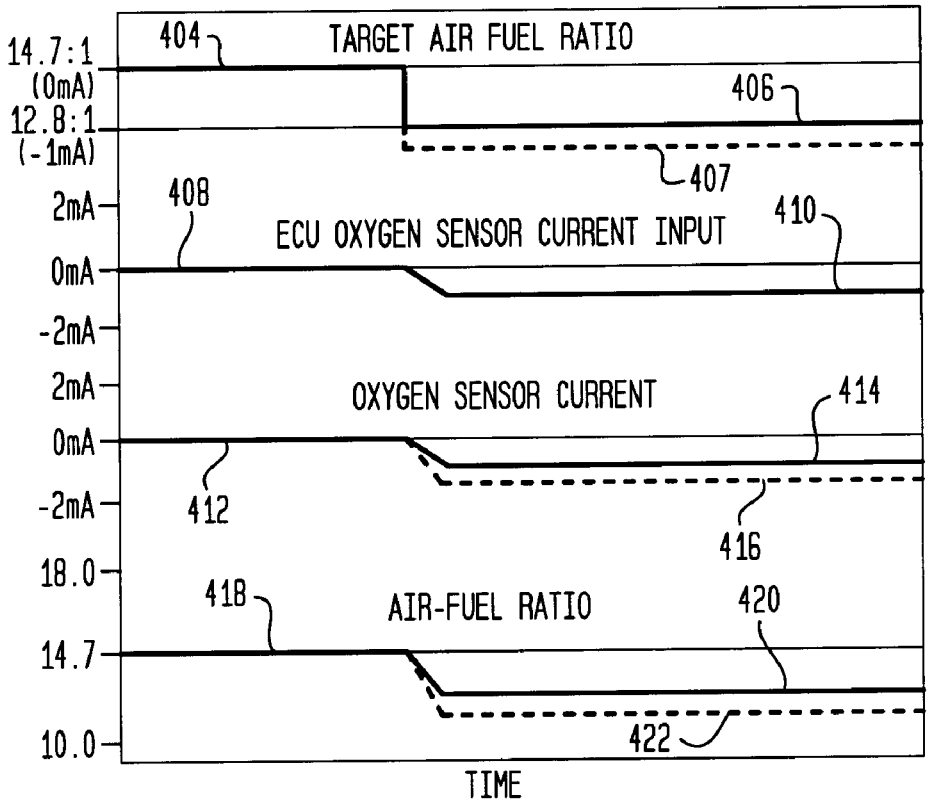
FIG. 4A is a timing diagram illustrating the operation of the fuel injection control system of FIG. 4 in accordance with the present invention.

The timing diagram of FIG. 4A illustrates the operation of the fuel injection control system of FIG. 4 for two cases: normal and modified. For normal (unmodified) operation, the wide band signal conditioning module 13A is absent. Waveforms depicted as a solid line, 404, 406, 408, 410, 412, 414, 418, 420 pertain to normal unmodified operation. Waveforms shown as dotted lines, 407, 416, 422 pertain to modified operation. For modified operation, the connection between the wide band oxygen sensor 17 and ECU 22 (FIG. 2) is broken, and the wide band signal conditioning module 13A (FIG. 4) is inserted between the wide band oxygen sensor 17 and the ECU 22.

In normal operation, without wide band signal conditioning module 13A present, the target air/fuel ratio goes from a first level 404 representing a first engine operating condition to a second level 406 representing a second engine operating condition. In response, ECU 22 increases the fuel flow to the fuel injectors lowering the air/fuel ratio from a first level 418 to a second level 420. At the same time, the oxygen sensor current goes down from a first level 412 to a second level 414. The wide band signal conditioning module 13A not being present, the oxygen sensor current output 414 is equal to the ECU 22 oxygen sensor current input current 410.

In accordance with the present invention, the insertion of the wide band signal conditioning module 13A modifies the fuel delivery profile for the engine. In particular, for the second level 406 of target air/fuel ratio, the presence of the wide band signal conditioning module 13A causes a new target air/fuel ratio 407 to be achieved. In order to achieve a new target air/fuel ratio 407, the signal conditioning module 13A amplifies the current from the wide band oxygen sensor by a multiplication factor (percentage increase or decrease) determined by the ratio between the original target fuel map and the desired modified fuel map. The wide band oxygen sensor current level is multiplied in the signal conditioning module 13A by the above multiplication factor to become a more negative value 416.

The ECU 22 is deceived because it receives a modified oxygen sensor current output level from the wide band signal conditioning module 13A in lieu of the actual oxygen sensor current level. Although the ECU 22 thinks the air/fuel ratio is at a level according to its internal programming, the actual resulting air/fuel ratio 422 is lower, representing a richer air/fuel mixture. A new target air/fuel ratio 407 has been achieved, while the ECU 22 receives output signals from the wide band signal conditioning module 13A representing the originally programmed target air/fuel ratio. The wide band signal conditioning module 13A tricks the ECU 22 into achieving a new target air/fuel ratio by appearing to be a wide band oxygen sensor operating at the originally programmed air/fuel ratio value.

Figure 5:
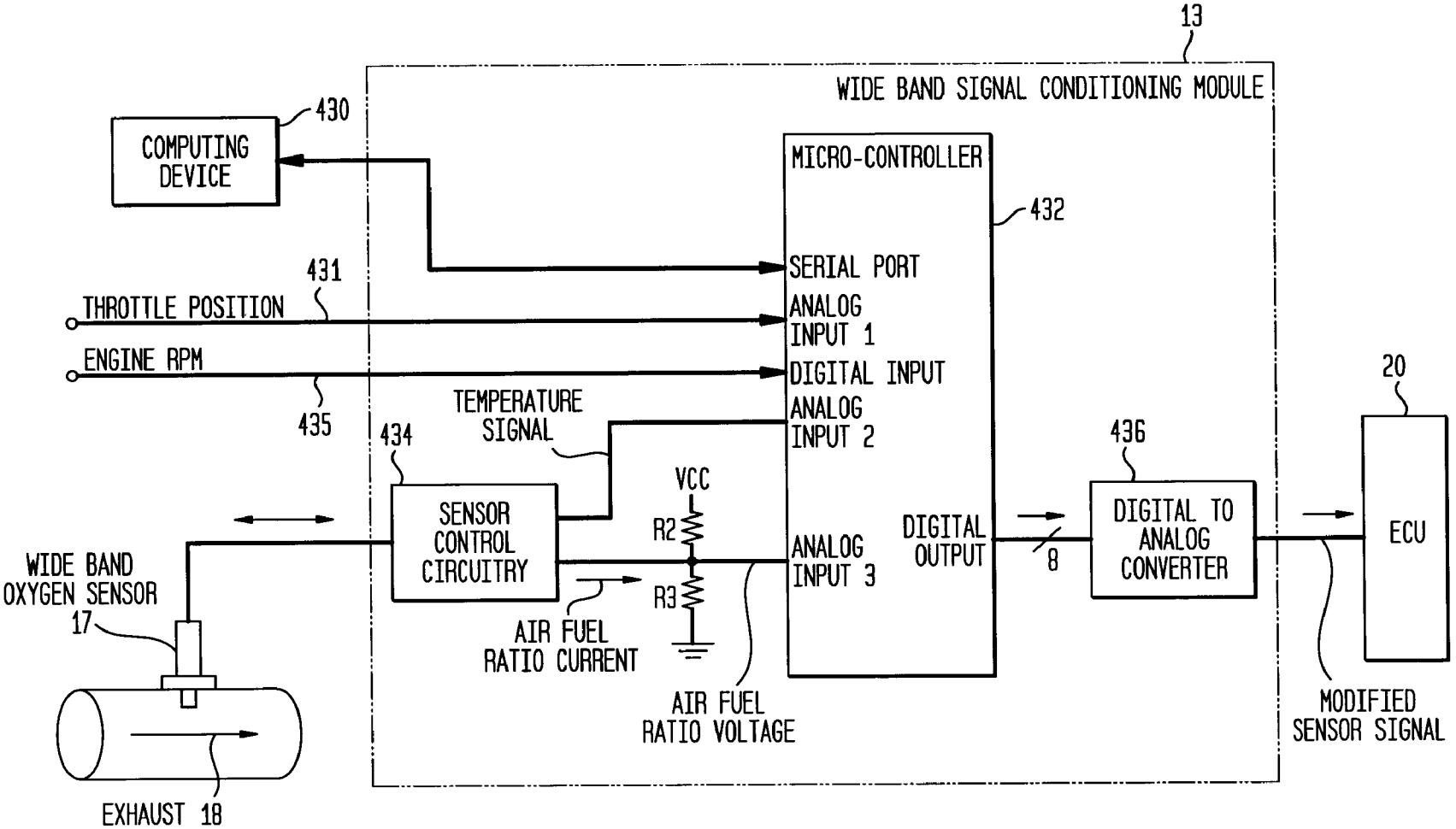
FIG. 5 is a schematic diagram, partially in block form, of a wide band signal-conditioning circuit embodying the present invention.

The block diagram of FIG. 5 represents a preferred embodiment of a wide band signal conditioning module 13 in FIG. 3. Wide band signal conditioning module is used in conjunction with a first type of ECU (20 from FIG. 3) that normally utilizes an air/fuel ratio signal from a standard oxygen sensor. The wide band signal-conditioning module 13 comprises sensor control circuitry 434, a resistor network R2, R3, a micro-controller 432 and a digital to analog converter 436. The micro-controller 432 includes a digital input and three analog inputs.

The input to the sensor control circuitry 434 is coupled to the output of a wide band oxygen sensor 17 disposed in the exhaust channel 18. A signal representing engine throttle position 431 is input to micro-controller 432 at analog input 1. A signal representing engine speed (RPM) 435 is a digital input to the micro-controller 431. The temperature signal from sensor control circuitry 434 is input to analog input 2 of the micro-controller 431. The air/fuel ratio current signal from the sensor control circuitry 434 is coupled to analog input 3 of the micro-controller 432 via the resistor network R2, R3. Input signals at analog input 1, analog input 2 and analog input 3 to the micro-controller 432 are internally converted to digital form inside the micro-controller 432.

The output of the micro-controller 432 is coupled to the input of a digital to analog converter 436 the output of which is the modified sensor signal to ECU 20. Finally, the micro-controller 432 includes a two-way serial port coupled to a computing device 430 such as a desktop or laptop computer.

As part of an initialization process, the wide band signal controller 13 receives a downloaded fuel map from an external computing device 430. For each engine operating condition (throttle position, engine RPM, etc.), the downloaded fuel map defines a new target air/fuel ratio. In operation, the sensor control circuitry 434 adjusts the power applied to a heater in the wide band oxygen sensor 17 that keeps a ceramic electrolyte therein at the proper controlled temperature. The sensor control circuitry 434 keeps the electrodes in the wide band oxygen sensor 17 biased at the proper voltage. The sensor control circuitry 434 also provides information regarding the temperature of sensor 17 to the micro-controller 432 at analog input 2. When properly biased and maintained at the proper temperature, the output air/fuel ratio current signal from the sensor control circuitry 434 (responsive to wide band oxygen sensor 17 input) is proportional to the air/fuel ratio of the intake gas mixture before combustion. The resistor network R2, R3 converts the air fuel ratio current signal from the sensor control circuitry 434 into a voltage signal suitable for input to the micro-controller 432 at analog input 3.

The micro-controller 432 monitors the digital value of the temperature signal on analog input 2 to determine the temperature of the wide band oxygen sensor 17. The air/fuel ratio current signal is valid only when the temperature of the wide band oxygen sensor 17 is within the proper temperature range. The output of the digital to analog converter 436 is the wide band oxygen sensor signal as modified in the wide band signal conditioning circuit 13 to be a standard oxygen sensor signal.

For each engine operating condition, the micro-controller 432 (via analog to digital converter 436) generates a rich or lean signal to ECU 20, which causes fuel flow to the fuel injectors to be respectively decreased or increased. The process continues until the wide band oxygen sensor indicates that the desired target air/fuel ratio has been achieved. ECU 20 receives a modified sensor signal from the wide band signal conditioning module which appears to the ECU 20 as a standard oxygen sensor.

The micro controller 432 in the block diagram of FIG. 5 may be programmed to implement the alternate embodiment of the present invention, embodied in wide band signal-conditioning module 13A shown in FIG. 4. In such case, analog to digital converter 436 has a current controlled output. That is, the output of the wide band signal conditioning module 13A is a current signal to be used in conjunction with a second type of ECU (22 from FIG. 4), normally utilizing an air/fuel ratio signal from a wide band oxygen sensor.

In the above alternative embodiment, for each engine operating condition (throttle position, RPM, etc.), the second type of ECU has a programmed air/fuel ratio in its internally stored fuel map. For each set of engine operating conditions (throttle position, RPM, etc.), the second signal-conditioning module stores a corresponding new target air/fuel ratio typically as a percentage (a multiplication factor) of the original target air/fuel ratio sensor current. The signal conditioning module 13A determines when the current signal from the wide band oxygen sensor represents the new target air/fuel ratio, and substitutes a current signal representing the programmed target air/fuel ratio value as an input signal to the second type of ECU (22 in figure). That is, the second signal-conditioning module simulates the necessary current signal level to the second type of ECU to produce the new target air/fuel ratio current signal from the wide band oxygen sensor.

What is claimed is:

1. In an internal combustion engine having a combustion chamber with an intake air channel, a fuel injector disposed in said intake air channel, an exhaust channel coupled to said combustion chamber, a standard oxygen sensor disposed in said exhaust channel, said standard oxygen sensor being of the type having a first output level indicating the presence of oxygen in said exhaust channel and a second output level indicating the absence of oxygen in said exhaust channel, and an electronic control unit connected to said standard oxygen sensor and responsive to said first and second output levels for controlling the amount of fuel injected by said fuel injector into said intake air channel, a method for modifying the operation of said internal combustion engine, said method comprising:

disconnecting said standard oxygen sensor from said electronic control unit;

installing a wide band oxygen sensor in said exhaust channel, said wide band oxygen sensor being of the type for sensing unburned fuel and oxygen in said exhaust channel and having an output signal proportional to the air/fuel ratio in said intake air channel;

providing a signal conditioning module have a respective input and output terminal;

connecting said output of said wide band oxygen sensor to said input terminal of a said signal conditioning module; and connecting said output terminal of said signal conditioning module to said electronic control unit.

2. A method in accordance with claim 1, wherein said signal conditioning module simulates said first and second output levels forming the output signal of a standard oxygen sensor at a stoichiometric air/fuel ratio to said electronic control unit.

3. A method in accordance with claim 1, wherein said signal conditioning module is responsive to all engine operating condition to simulate said first and second output levels forming the output signal of a standard oxygen sensor at a stoichiometric air/fuel ratio to said electronic control unit.

4. A method in accordance with claim 3, wherein said engine operating condition is throttle position.

5. A method in accordance with claim 3, wherein said engine operating condition is engine speed.

6. In an internal combustion engine combination comprising:

a combustion chamber;

an intake air channel coupled to said combustion chamber;

a fuel injector disposed in said intake channel;

an exhaust channel coupled to said combustion chamber;

a wide band oxygen sensor disposed in said channel, said wide band oxygen sensor being of the type for sensing unburned fuel and oxygen in said exhaust channel and having an output signal proportional to the air/fuel ratio in said intake air channel;

a signal conditioning module coupled to said wide band oxygen sensor; and an electronic control unit coupled to said signal conditioning module;

wherein said signal conditioning module modifies the operation of said internal combustion engine by modifying said signal from said wide band oxygen sensor;

wherein said signal conditioning module is responsive to said wide band oxygen sensor to simulate a standard oxygen sensor of the type having a first output level indicating the presence of oxygen in said exhaust channel and a second output level indicating the absence of oxygen in said exhaust channel.

7. An apparatus in accordance with claim 6, wherein said signal conditioning module simulates said first and second output levels forming the output signal of a standard oxygen sensor at a stoichiometric air/fuel ratio to said electronic control unit.

8. An apparatus in accordance with claim 6, wherein said signal conditioning module is responsive to an engine operating condition to simulate said first and second output levels forming the output signal of a standard oxygen sensor at a stoichiometric air/fuel ratio to said electronic control unit.

9. An apparatus in accordance with claim 8, wherein said engine operating condition is throttle position.

10. An apparatus in accordance with claim 8, wherein said engine operating condition is engine speed.

11. An apparatus in accordance with claim 6, wherein said signal conditioning module is responsive to said wide band oxygen sensor operating at a programmed target air/fuel ratio to simulate an output signal of a wide band oxygen sensor operating at a new target air/fuel ratio in said intake air channel.

12. An apparatus in accordance with claim 11, wherein said signal conditioning module is responsive to an engine operating condition to simulate said output signal of a wide band oxygen sensor operating at said new target air/fuel ratio in said intake air channel to said electronic control unit.

13. An apparatus in accordance with claim 12, wherein said engine operating condition is throttle position.

14. An apparatus in accordance with claim 12, wherein said engine operating condition is engine speed.

15. In an internal combustion engine having a combustion chamber with an intake air channel, a fuel injector disposed in said intake air channel, an exhaust channel coupled to said combustion chamber, a wide band oxygen sensor disposed in said exhaust channel, said wide band oxygen sensor being of the type for sensing unburned fuel and oxygen in said exhaust channel and having an output signal proportional to the air/fuel ratio in said intake air channel, and an electronic control unit connected to said wide band oxygen sensor and responsive to said output signal from said wide band oxygen sensor for controlling the amount of fuel injected by said fuel injector into said intake air channel, a method for modifying the operation of said internal combustion engine, said method comprising:

disconnecting said wide band oxygen sensor from said signal conditioning module;

providing a signal conditioning module have a respective input and output terminals;

connecting said output of said wide band oxygen sensor to said input terminal of a said signal conditioning module; and connecting said output terminal of said signal conditioning module to said electronic control unit.

16. An method in accordance with claim 15, wherein said signal conditioning module is responsive to said wide band oxygen sensor operating at a programmed target air/fuel ratio to simulate an output signal of a wide band oxygen sensor operating at a new target air/fuel ratio in said intake air channel.

17. A method in accordance with claim 16, wherein said signal conditioning module is responsive to an engine operating condition to simulate said output signal of a wide band oxygen sensor operating at said new target air/fuel ratio in said intake air channel to said electronic control unit.

18. A method in accordance with claim 17, wherein said engine operating condition is throttle position.

19. A method in accordance with claim 17, wherein said engine operating condition is engine speed.

* * * * *